US009492726B2

(12) United States Patent
Bundy et al.

(10) Patent No.: US 9,492,726 B2
(45) Date of Patent: Nov. 15, 2016

(54) APPARATUS, SYSTEM, AND METHOD FOR SELF-PROPELLED ROPING TRAINING SYSTEM

(71) Applicants: Dorian A. Bundy, Washington, UT (US); Travis D. Kunz, Santaquin, UT (US)

(72) Inventors: Dorian A. Bundy, Washington, UT (US); Travis D. Kunz, Santaquin, UT (US)

( * ) Notice: Subject to any disclaimer, the term of this patent is extended or adjusted under 35 U.S.C. 154(b) by 178 days.

(21) Appl. No.: 14/543,699

(22) Filed: Nov. 17, 2014

(65) Prior Publication Data

US 2015/0145210 A1 May 28, 2015

Related U.S. Application Data

(60) Provisional application No. 61/904,557, filed on Nov. 15, 2013.

(51) Int. Cl.
*A63B 69/00* (2006.01)

(52) U.S. Cl.
CPC ..... *A63B 69/0068* (2013.01)

(58) Field of Classification Search
CPC ..... A63B 69/0069
USPC ..... 273/359, 336, 317, 348; 119/839
See application file for complete search history.

(56) References Cited

U.S. PATENT DOCUMENTS 3,406,969 A * 10/1968 Tisdell ..... A63B 67/00 119/839
3,802,706 A * 4/1974 Hamm ..... A01K 15/02 119/839
3,947,033 A 3/1976 Bennett
4,266,779 A 5/1981 English
4,286,788 A * 9/1981 Simington ..... A63B 69/0068 119/839
4,738,223 A * 4/1988 Andreasen ..... A01K 15/027 119/839
4,874,179 A 10/1989 Henderson
4,960,076 A 10/1990 Snorgrass et al.
4,995,618 A 2/1991 Panzner
5,009,432 A 4/1991 Richard
5,080,373 A 1/1992 Jones
5,568,926 A 10/1996 Kaptein
5,709,386 A 1/1998 Nelson
6,736,399 B1 5/2004 Copenhaver
6,945,534 B1 9/2005 Lindsey
7,293,775 B1 11/2007 Donnelly
2008/0289585 A1* 11/2008 Suggs, Sr. ..... A01K 15/027 119/839
2015/0145210 A1* 5/2015 Bundy ..... A63B 69/0068 273/359

OTHER PUBLICATIONS

Heel-O-Matic, www.heelomatic.com, 2008.
Hot Heels, wwwropehotheels.com, 2002.
Sparky Superior Roping Machines, www.sparkyroping.com, known about as early as 2008.

* cited by examiner

*Primary Examiner* — Raleigh W Chiu
(74) *Attorney, Agent, or Firm* — Kunzler Law Group

(57) ABSTRACT

An apparatus and device are provided for a self-propelled roping training system. The apparatus includes an endless track comprising a plurality of corner sections, each of the plurality of corner sections comprising an arc length, a carriage assembly comprising a front slider assembly coupled with the track and a rear slider assembly coupled with the track, and a self-propelled vehicle coupled with the carriage assembly configured to follow a path defined by the endless track.

20 Claims, 10 Drawing Sheets

APPARATUS, SYSTEM, AND METHOD FOR SELF-PROPELLED ROPING TRAINING SYSTEM

CROSS-REFERENCES TO RELATED APPLICATIONS

This application claims the benefit of and claims priority to U.S. Provisional Patent Application No. 61/904,557 entitled "APPARATUS, SYSTEM, AND METHOD FOR SELF-PROPELLED ROPING TRAINING SYSTEM" and filed on Nov. 15, 2013 for Dorian Bundy et al., which is incorporated herein by reference.

TECHNICAL FIELD

The present disclosure relates devices for to roping skills training, and more particularly relates to automated training devices for practicing roping skills

BACKGROUND

Roping is perhaps one of the oldest skills practiced by those engaged in cattle ranching operations. It remains a vital skill for those involved in handling cattle on the open range and in other settings, even in the most modern of ranching operations.

Interest in developing roping skills and in roping competition has also steadily increased, particularly with the advent of rodeo and jackpot team roping, which has become one of the more popular forms of equestrian competition. Currently, over a hundred thousand team ropers compete each year for millions of dollars in prize money. These competitions are held throughout the West, Mid-West and Southern States.

Team roping is a form of roping that involves one team member, the header, roping the head and the other team member, the heeler, roping the hind legs of the steer. Because of the highly competitive nature of this event, a high level of proficiency involving split second timing is required for the header. The high level of proficiency required can only be developed through a considerable amount of repetitive practice.

Because there is only a limited number of practice animals and limited facilities for practicing, finding opportunities to practice roping skills on live animals is difficult. Furthermore, obtaining and maintaining a collection of livestock and a large arena with the required facilities is very costly. Also, it is very difficult to make efficient use of one's time in practicing with live animals. Accordingly, there has long been a need for alternative means for practice and training.

Training devices of various kinds have been developed through the years to assist in the training of headers. Since most headers prefer to rope just the horns of the steer, a simple training device is a set of horns that can be affixed to a bale of hay or some other anchoring object. However, because in competition a heeler must wait until the header has roped the head of the steer, heelers require a device that allows them to practice timing and roping moving heels. Another simple device may include a dummy steer head, with dimensions approximating a typical steer head and with horns of a fixed length. Such devices may be mounted on a mobile object such as an all terrain vehicle (ATV) or a simulated steer pulled behind a motor vehicle to provide for some in-motion training from horseback.

Such devices provide an alternative means for practicing steer head roping without the use of live animals. However, even though existing devices may be mounted on mobile platforms, the existing devices do not closely simulate the movement of a live animal.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of embodiments of the disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

Figure 1:
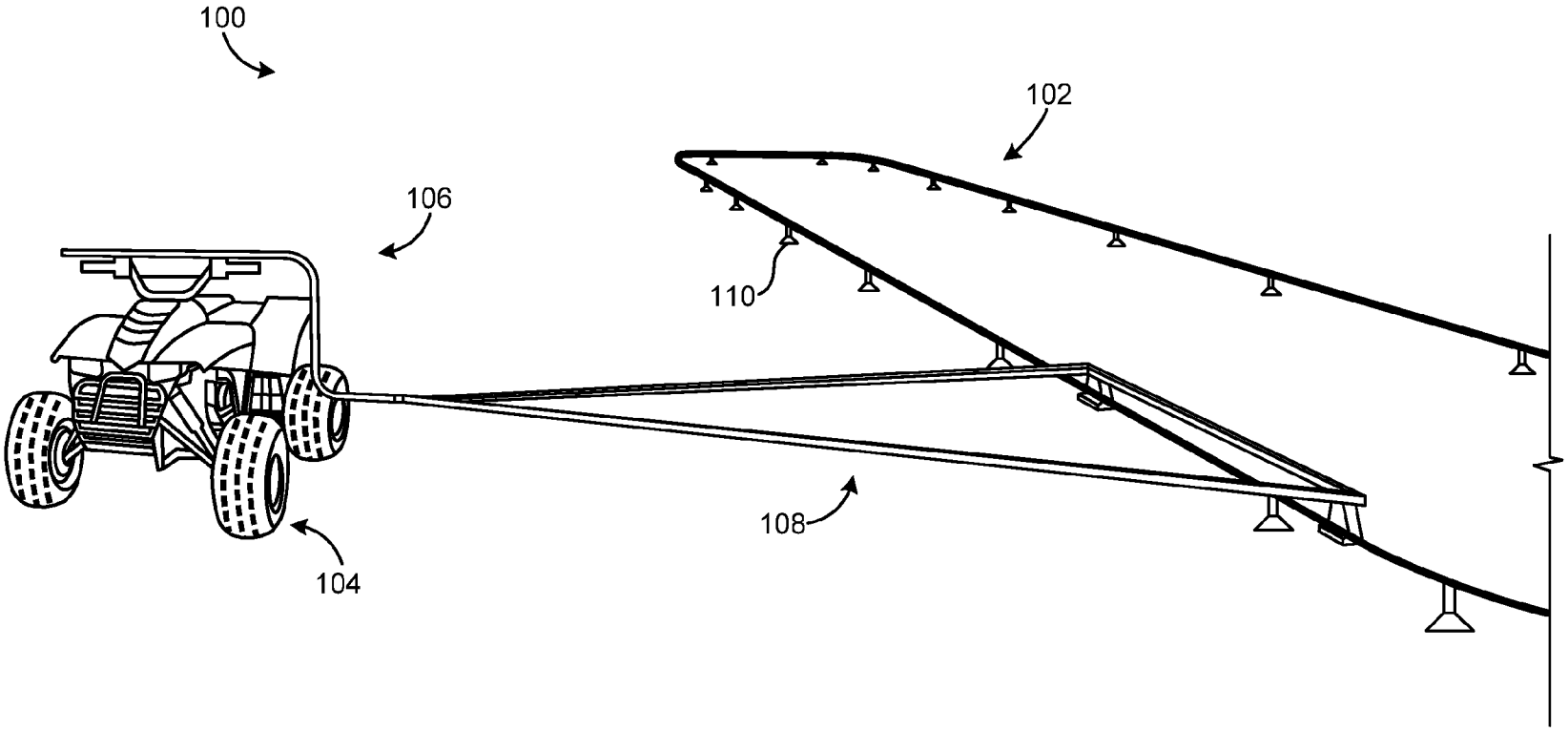
FIG. 1 is a perspective view illustration of a system for a self-propelled roping training system in accordance with embodiments of the disclosure.

FIG. 1 is a perspective view illustration of a system 100 for a self-propelled roping training system in accordance with embodiments of the disclosure. The system, in one embodiment, comprises an endless track 102, and a powered vehicle 104 coupled with the endless track ("track") 102. A steering arm 106 together with an attachment carriage 108 couple the powered vehicle 104 to the track 102.

In one embodiment, the steering arm 106 is formed, in one embodiment, of a length of tubing and configured to interface with the steering controls of the powered vehicle ("vehicle") 104. In the depicted embodiment, the vehicle 104 is an all-terrain vehicle, and the steering control is the handlebar of the all-terrain vehicle. Alternatively, the steering arm 106 may be formed to interface with other vehicles 104 capable of travelling at a speed desirable for roping training. In one embodiment, this speed is in the range of between about 1 and 15 miles per hour. In a further embodiment, the vehicle 104 is configured to travel at a speed comparable to that of a running steer.

The steering arm 106, in one embodiment, may be coupled with the steering control of the vehicle 104 by way of a plurality of u-bolts (not shown) or by other suitable attachment means. The steering arm 106 may be rigidly coupled with the attachment carriage ("carriage") 108. For example, the steering arm 106 may be integrally formed with one side of the carriage 108, or alternatively, detachably formed. In an alternative embodiment, the steering arm 104 may be pivotally connected with the carriage 108.

In one embodiment, the carriage 108 is formed of tubing in a triangular shape as depicted. The track 102, steering arm 104, and carriage 108 may be formed of schedule 40 iron tubing. In other embodiments, the track 102, steering arm 104, and carriage 108 may be formed of 1¼" outside diameter heavy wall tubing. Alternatively, the track 102, steering arm 104, and carriage 108 may be formed of any material with enough strength to maintain the vehicle 104 on a path defined by the track 102.

In one embodiment, a plurality of feet 110 may be coupled to the track 102 and configured to suspend the track a defined distance above the ground. In one embodiment, the distance is selected to allow the carriage 108 to travel around (either forwards or backwards) around the track. In one embodiment, this distance is in the range of between about 1 and 12 inches. The feet 110 may be secured to the ground with, for example, a stake.

Figure 2:
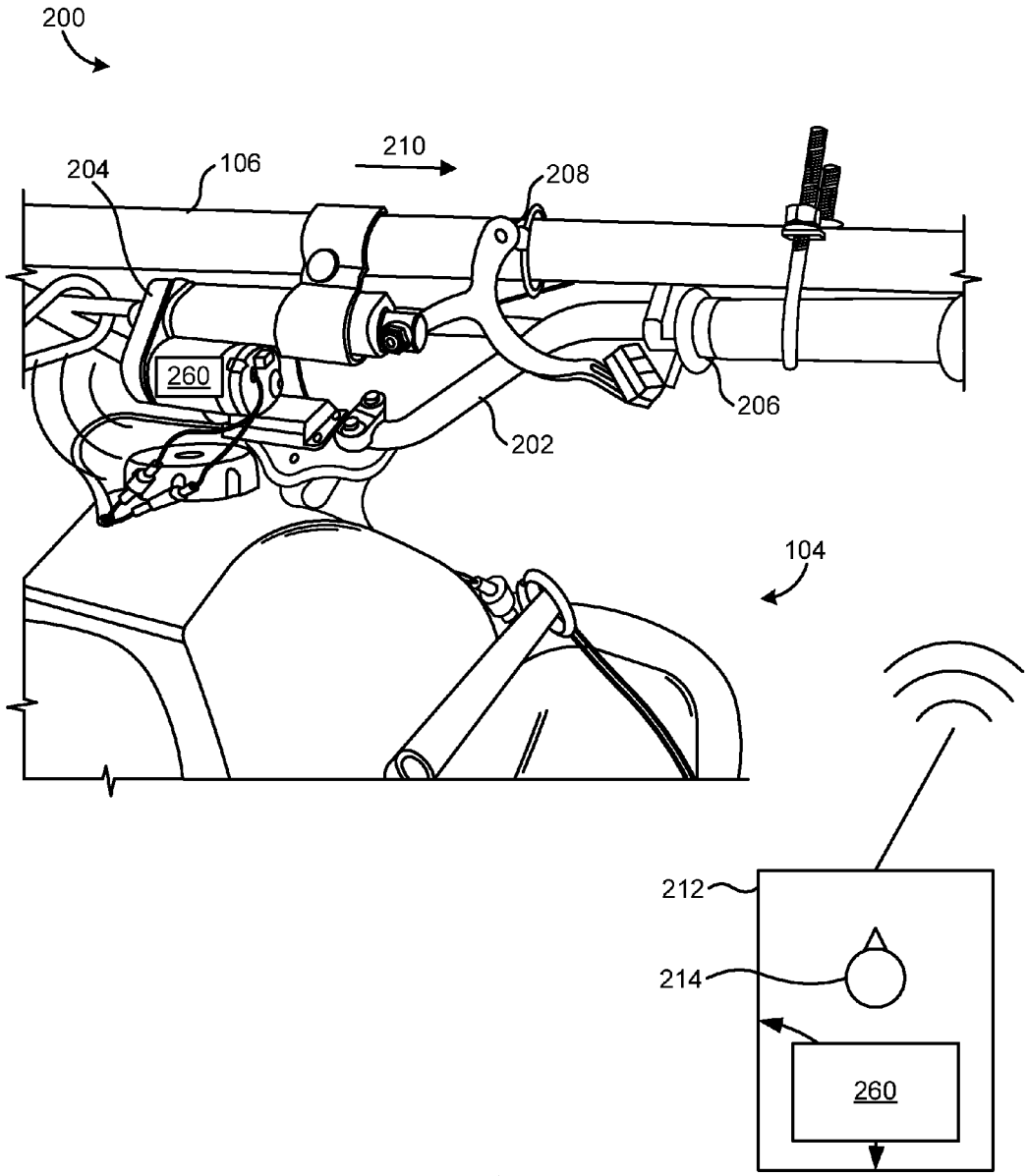
FIG. 2 is a perspective view illustration showing one embodiment of the steering arm in accordance with embodiments of the disclosure.

FIG. 2 is a perspective view illustration showing one embodiment of the steering arm 106 in accordance with embodiments of the disclosure. As depicted, the steering arm 106 is configured to engage the steering control 202, or handlebars, of the vehicle 104 and subsequently direct the vehicle 104 to follow a path defined by the track 102. Alternatively, the steering arm 106 may be coupled directly with the steering system of the vehicle 104. For example, the steering arm 106 may be configured to engage the rack and pinion system of a car.

The steering arm 106, in one embodiment, includes an actuator 204 for engaging a throttle 206 of the vehicle 104. A throttle arm 208 is disposed between the actuator 204 and the throttle 206. The throttle arm 208 is configured to couple the actuator 204 and the throttle 206 such that activation of the actuator 204 causes the engagement of the throttle 206. For example, activation of the actuator 204 will extend the throttle arm 208 in a direction indicated by arrow 210 towards the throttle 206 and subsequently cause the vehicle 104 to accelerate.

The actuator 204 in the depicted embodiment is a stepper motor configured to enable a range of throttle engagements and vehicle 104 speeds.

Alternatively, other types of actuators may be utilized, including, but not limited to, hydraulic actuators, screw-type motors, timer relays, etc. Another example (not shown) of an actuator 204 capable of engaging the throttle 206 is an actuated throttle spool that extends and retracts a throttle cable coupled with the motor of the vehicle 104.

Alternatively, the vehicle 104 may comprise an electronically controlled speed controller. The electronically controlled speed controller may be configured to communicate wirelessly with a controller 212. In one embodiment, the controller comprises a knob 214 for selecting the speed of the vehicle 104 as the vehicle 104 travels around the track of FIG. 1. In another embodiment, the controller 212 may be configured to detect when a person has roped a towable dummy, and upon this detection, stop the vehicle. For example, the controller 212 may be configured to detect that a horse carrying the person has abruptly stopped. In another embodiment, the controller 212 may be configured to detect increased load on the vehicle as a result of the roper slowing down the towable dummy. In other embodiments, the logic to detect that the rider has roped the towable dummy may be implemented within the actuator or the electronically controlled speed controller.

In other embodiments, the controller 212 may contain logic implemented as a control module 260 configured to detect a successful "catch" of the roping device 802 and subsequently slow the vehicle 104. The control module 260 is also configured to resume the speed of the vehicle 104 after a towable roping dummy has been released. As such, the vehicle will continue around the track 102 and return to start a new practice session. In a further embodiment, the control module 260 is configured to detect emergency situations and stop the vehicle 104. For example, in the unlikely event that the vehicle became detached from the track or the carriage, the control module 260 is configured to stop the vehicle 104. Additionally, the control module 260 is configured to communicate wirelessly with the controller 212 of FIG. 2. The control module 260, therefore, maintains the vehicle 104 at the speed designated by the controller 212. The control module 260 may be implemented in both the vehicle and the controller 212.

Figure 3A:
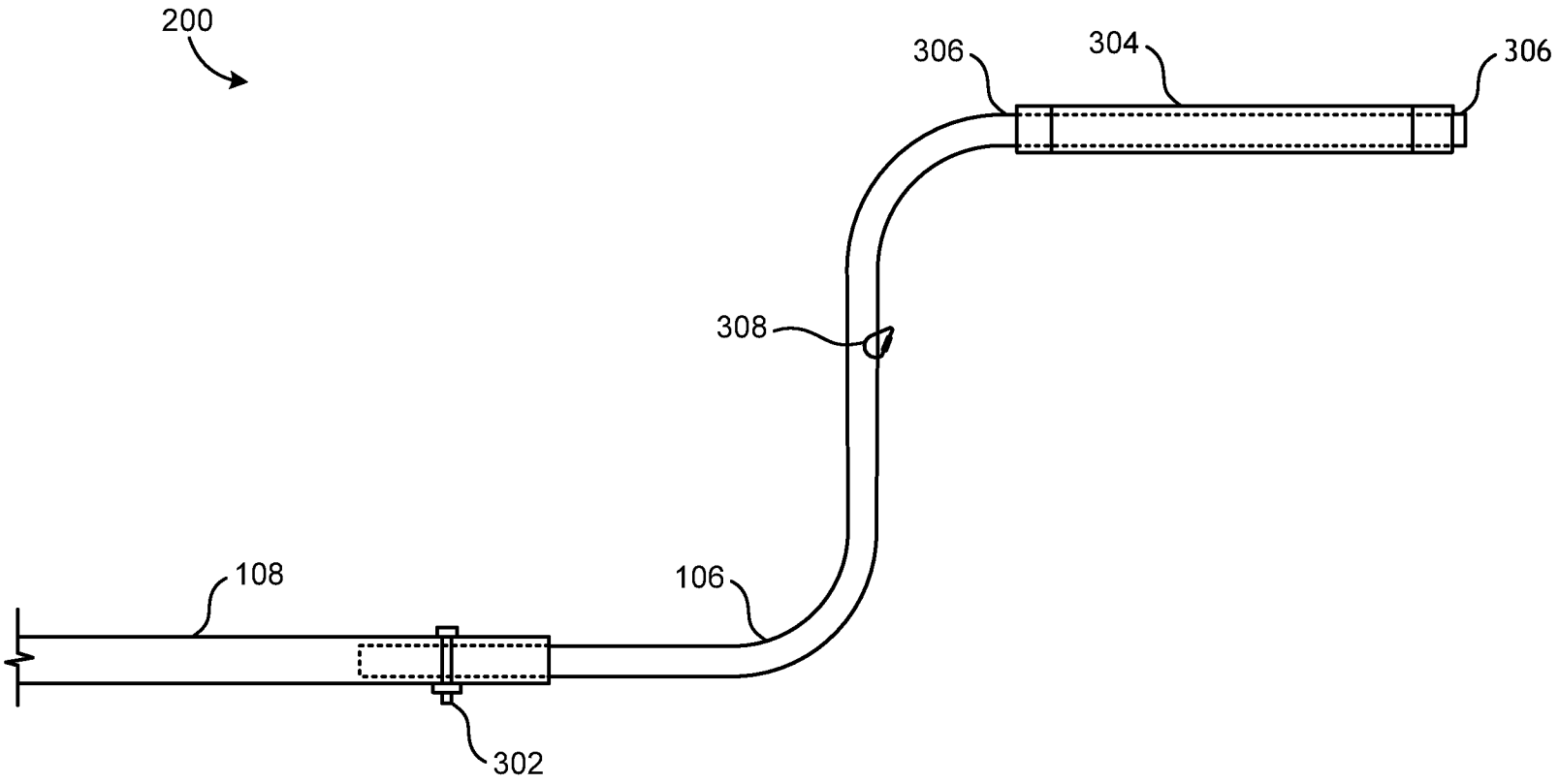
FIG. 3*a* is a schematic diagram illustrating another embodiment of the steering arm in accordance with embodiments of the disclosure.

FIG. 3*a* is a schematic diagram illustrating another embodiment of the steering arm 106 in accordance with embodiments of the disclosure. In the depicted embodiment, the steering arm 106 is detachably and rigidly coupled with the carriage 108. An end of the steering arm 106 is configured to engage an opening in the carriage 108. A bolt pin 302 couples the steering arm 106 with the carriage 108.

In a further embodiment, the steering arm 106 comprises a pivot arm 304. The pivot arm 304 is a sleeve having a slightly larger diameter than the steering arm 106 so that the pivot arm 304 may freely rotate about the steering arm 106. A plurality of bushings 306 secure the pivot arm 304 and maintain the lateral position of the pivot arm while allowing the pivot arm 304 to rotate around the steering arm 106. This enables the carriage 108 and the steering arm 106 to guide the vehicle 104 around the track without "binding" or "tipping" of the vehicle 104.

The steering arm 106 may also comprise a quick link 308 for attaching a security cable (not shown). The security cable may operate to shut down the vehicle 104 in the event the vehicle becomes detached from the steering arm 106. Alternatively, the quick link 308 and the security cable may operate as a secondary system or reinforcement for coupling the vehicle 104 to the carriage 108. Furthermore, the security cable may be configured to aide in steering the vehicle 104 by "pulling" on the handlebars of the vehicle 104 as the carriage 108 travels around a corner in the track 102.

Figure 3B:
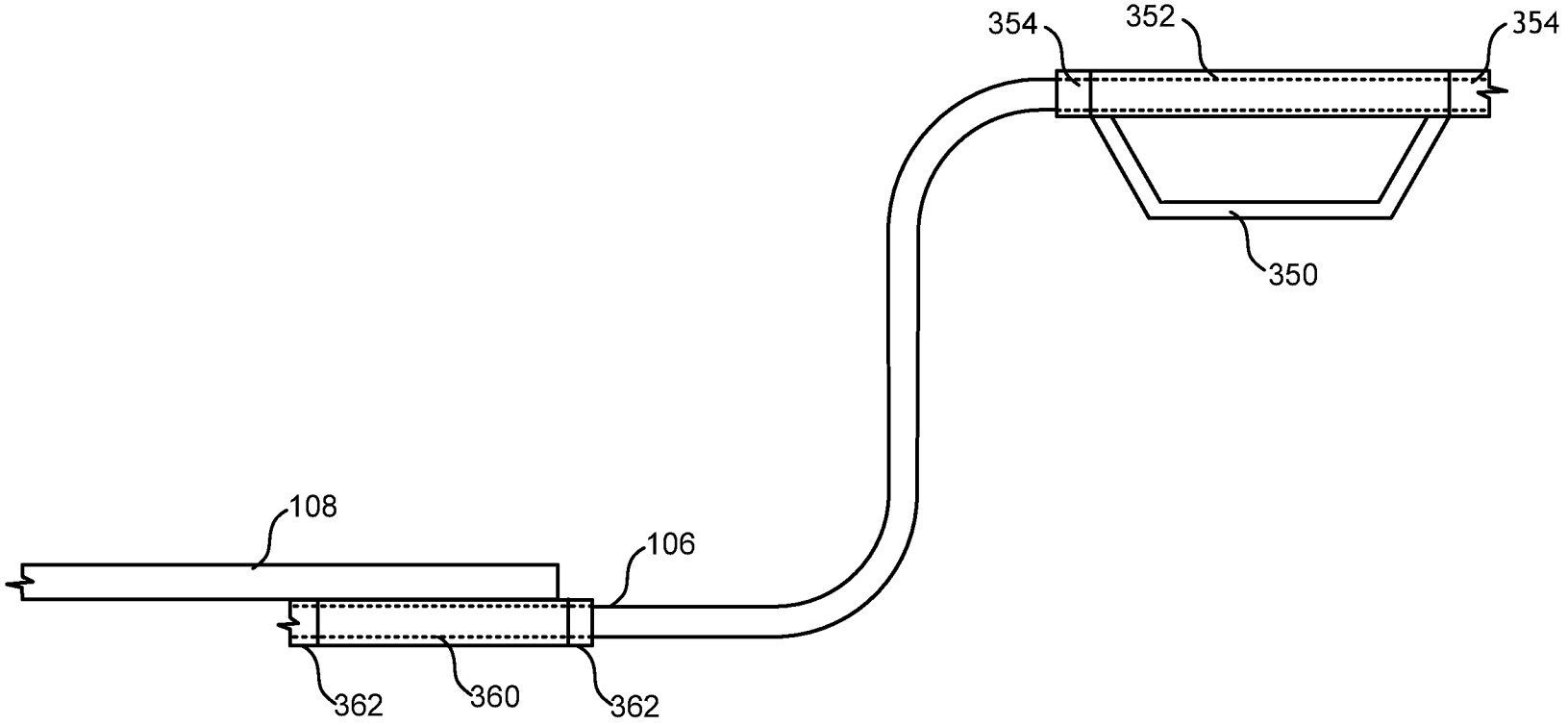
FIG. 3*b* is a side view schematic drawing illustrating another embodiment of the steering arm in accordance with embodiments of the disclosure

FIG. 3*b* is a side view schematic drawing illustrating another embodiment of the steering arm 106 in accordance with embodiments of the disclosure. In one embodiment, the steering arm 106 may be formed with an integrated handlebar 350. The integrated handlebar may be rigidly or pivotally coupled with the steering arm 106. In the depicted embodiment, the integrated handlebar 350 is coupled with a sleeve 352 that is configured to pivot about the steering arm 106. The sleeve 352 may be fixed laterally with inner and outer bushings 354 that prevent the sleeve 352 from moving towards the carriage arm 108 or away from the carriage arm 108. The bushings 354, however, permit the rotation of the sleeve with respect to the steering arm 106.

In one embodiment, the sleeve 352 is formed having an inner diameter selected to engage the outer surface of the steering arm 106. The integrated handlebar 350 may be formed having the same inner diameter, or in another embodiment, the integrated handlebar 350 may be formed with an outer diameter of about ¾". The integrated handlebar 352 is configured to attach to the triple clamp of the vehicle 104 of FIG. 1, and as such, the integrated handlebar 352 may have a shape and size selected to resemble the handlebars of vehicle 104. In other embodiments, the integrated handlebar 352 may be formed with a width of about 11½".

In one embodiment, the steering arm 106 may couple with the carriage arm 108 in a manner similar to the sleeve 352 of the integrated handlebar 350. In other words, a carriage sleeve 360 may be coupled with the carriage arm 108. The carriage sleeve 360, in one embodiment, is welded adjacent and below the carriage arm 108 as depicted. In alternative embodiments, the carriage sleeve 360 may be positioned above or to the side of the carriage arm 108. The carriage sleeve 360, in one embodiment, is configured to rotatably couple the carriage arm 108 with the steering arm 106. To accomplish this, inner and outer bushings 362 may laterally couple the carriage sleeve 360 with the steering arm while allowing rotation of the carriage sleeve 360 with respect to the steering arm 106. In other embodiments, the carriage sleeve 360 may be rigidly coupled with the steering arm 106 and rotatably coupled with the carriage arm 108.

Figure 4:
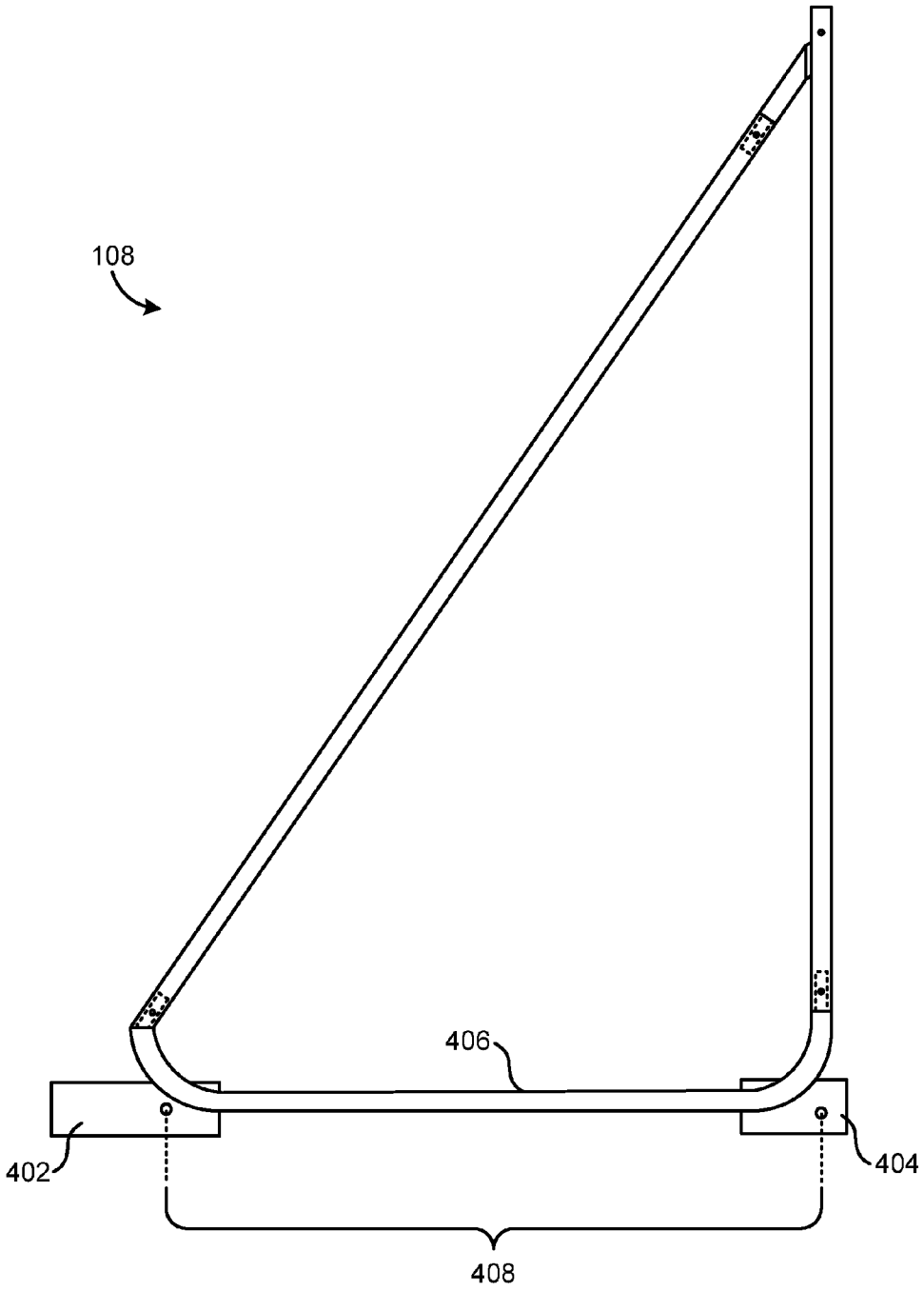
FIG. 4 is a schematic diagram illustrating one embodiment of the carriage in accordance with embodiments of the disclosure.

FIG. 4 is a schematic diagram illustrating one embodiment of the carriage 108 or carriage arm in accordance with embodiments of the disclosure. In the depicted embodiment, the carriage 108 is configured in the shape of a triangle. In a further embodiment, the carriage 108 is configured as a triangle having angles of 30, 60, and 90 degrees. The corners of the triangle may be formed as depicted, or in any suitable manner. Alternatively, the carriage 108 may be formed in the shape of a rectangle or a square, or other shape that is capable of directing a vehicle to follow a path defined by the track as shown above in FIG. 1.

The carriage 108 includes a front slider assembly 402 and a rear slider assembly 404. The structure of the front and rear slider assemblies will be described below with reference to FIGS. 5 and 6. The carriage, in one embodiment, is formed having a length of tubing 406 disposed between the front and rear slider assemblies 402, 404. The length 408 of tubing 406 is selected to separate the slider assemblies by a distance equivalent to the corner arc length of the track 102 of FIG. 1. Alternatively, the length 408 of the tubing 406 may be any length that allows the carriage to travel around a corner without binding. In one embodiment, this length is in the range of between about 69" and 72" as measured from a center of a caster of the first slider 404 to a center of a caster of the second slider 404. In a further embodiment, the distance 408 is about 70 ⅝" when an arc length of a corner of the track is about 8 feet.

Figure 5:
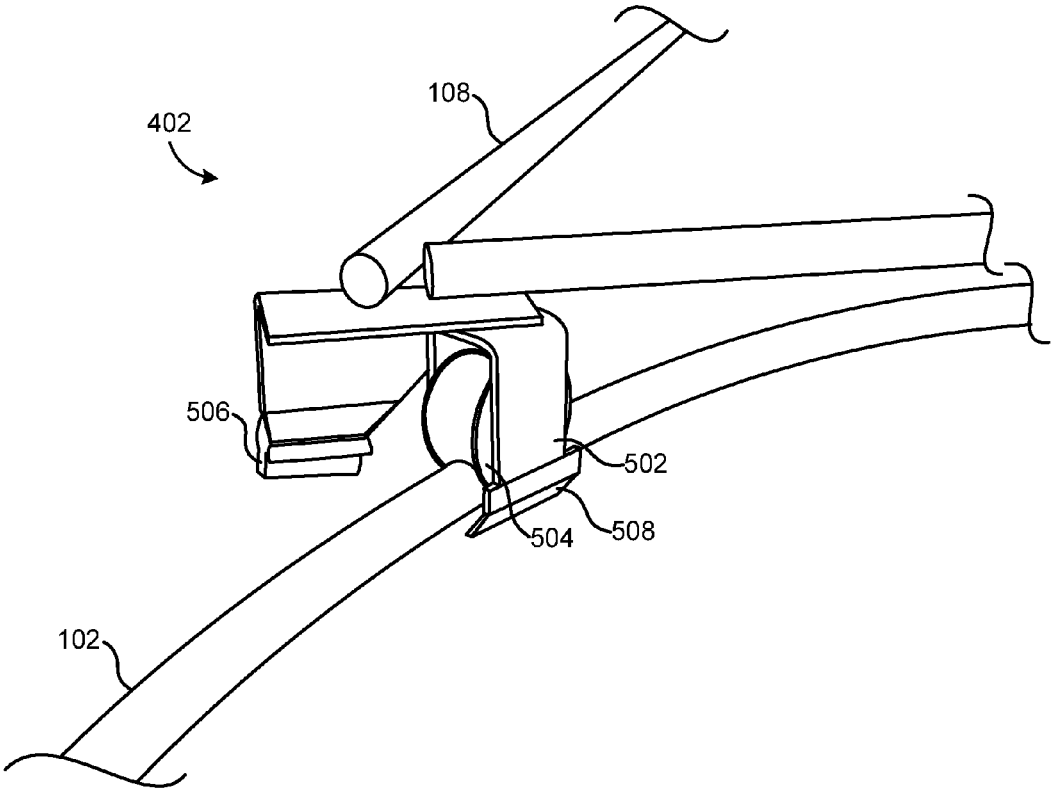
FIG. 5 is a perspective view diagram illustrating one embodiment of the front slider assembly in accordance with embodiments of the disclosure.

FIG. 5 is a perspective view diagram illustrating one embodiment of the front slider assembly 402 in accordance with embodiments of the disclosure. In the depicted embodiment, the front slider assembly 402 comprises a bogie housing 502 pivotally coupled with the carriage 108. The bogie housing 502 maintains a bogie 504 or caster configured to engage the track 102. The front slider assembly 402 also comprises a guide 506 and a slider 508.

In one embodiment, the guide 506 is configured to prevent over-rotation of the carriage 108 due to the momentum of the vehicle 104. For example, while the carriage 108 is travelling around a corner, as in FIG. 5, the guide 506 separates from the track 102. However, as the carriage 108 enters a straight portion of the track 102, the guide 506 comes back into contact with the track 102 and helps steer the vehicle 104 accordingly. In a further embodiment, the rear slider assembly 404 may be configured with a similar guide 506 to allow the vehicle to travel in a reverse direction. The guide 506 may be formed of Teflon, or alternatively, some other material having a low coefficient of friction.

Figure 6:
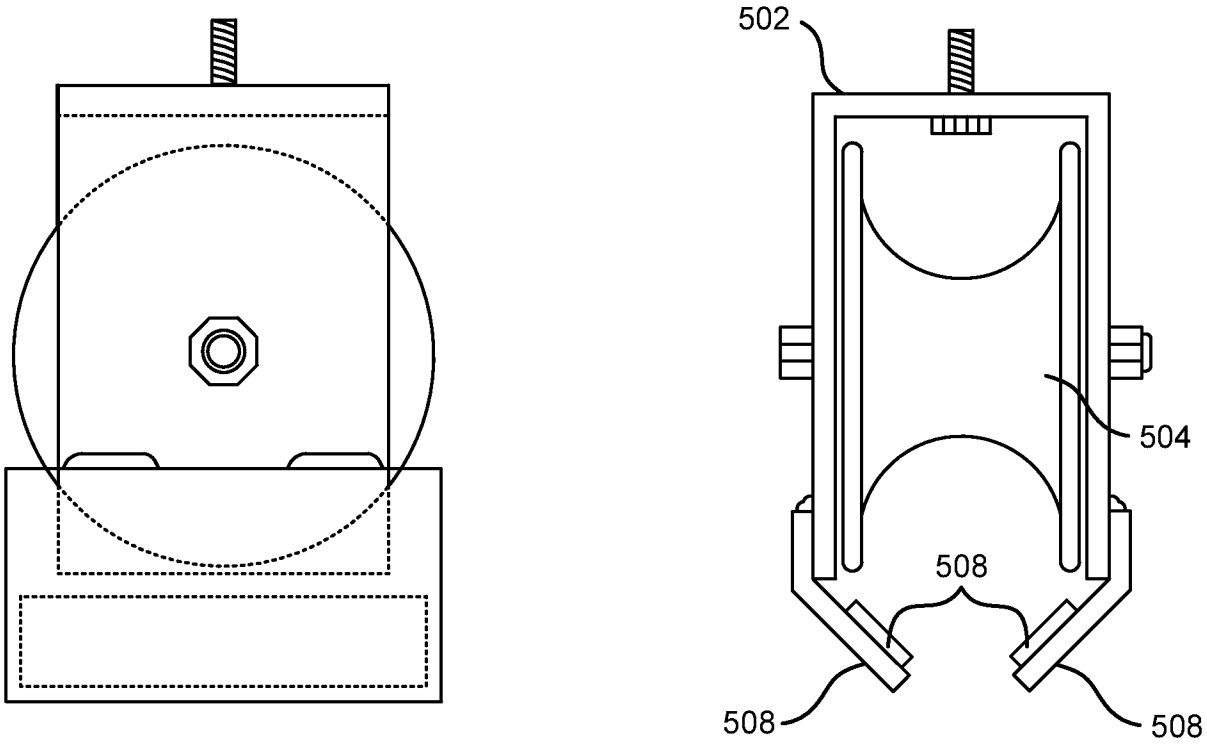
FIG. 6 is a schematic diagram illustrating another embodiment of the bogie housing in accordance with embodiments of the disclosure.

FIG. 6 is a schematic diagram illustrating another embodiment of the bogie housing 502 in accordance with embodiments of the disclosure. In the depicted embodiment, the bogie housing 502 comprises the bogie 504 or caster and the sliders 508. The bogie 504, in one embodiment, may comprise a double flanged track wheel having a profile selected to engage the track 102. The bogie 504 may be formed of Teflon and Nylon, or alternatively a metal-based composite.

The housing 502, in one embodiment, further comprises the sliders 508 extending downward from the housing 502 and angled to partially encompass the track 102 to prevent the front or rear slider assemblies from disconnecting from the track 102. The sliders 508 may further comprise Teflon pads 510 for reducing friction and enabling the carriage to travel around the track 102.

Figure 7A:
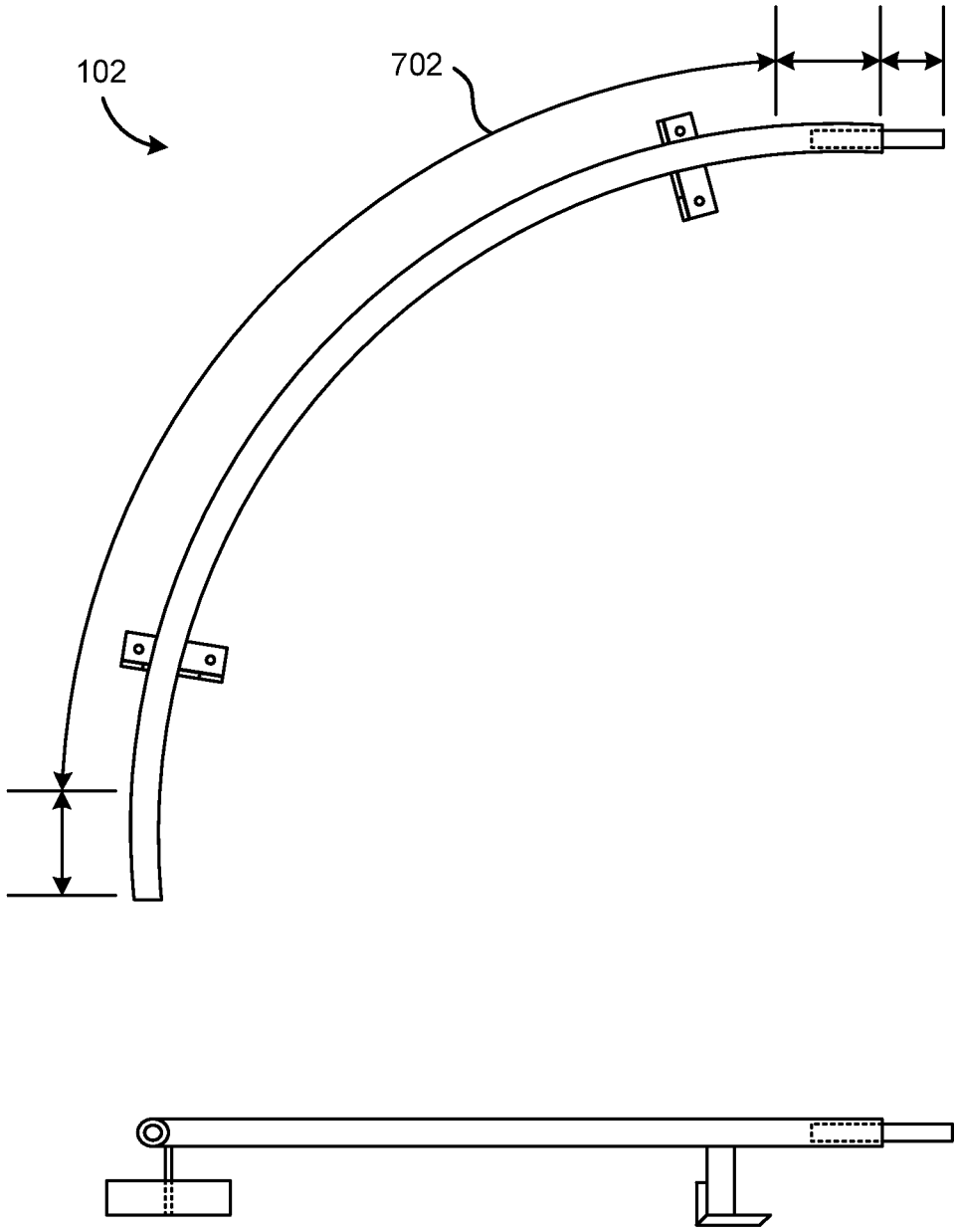
FIG. 7*a* is a schematic diagram illustrating one embodiment of a corner of the track in accordance with embodiments of the disclosure.

FIG. 7*a* is a schematic diagram illustrating one embodiment of a corner of the track 102 in accordance with embodiments of the disclosure. The corner 702, as described above, has an arc length substantially equivalent to the distance between the front and rear slider assemblies 402, 404 of FIG. 4. Each endless track 102 is formed of a plurality of corners 702, each corner 702 defining a 90 degree turn. The corners 702 may be configured in such a way as to appear as a single 180 degree turn, or alternatively a length of straight tubing may separate the corners 702 effectively creating a track 102 that resembles a rounded rectangle or square.

Figure 7B:
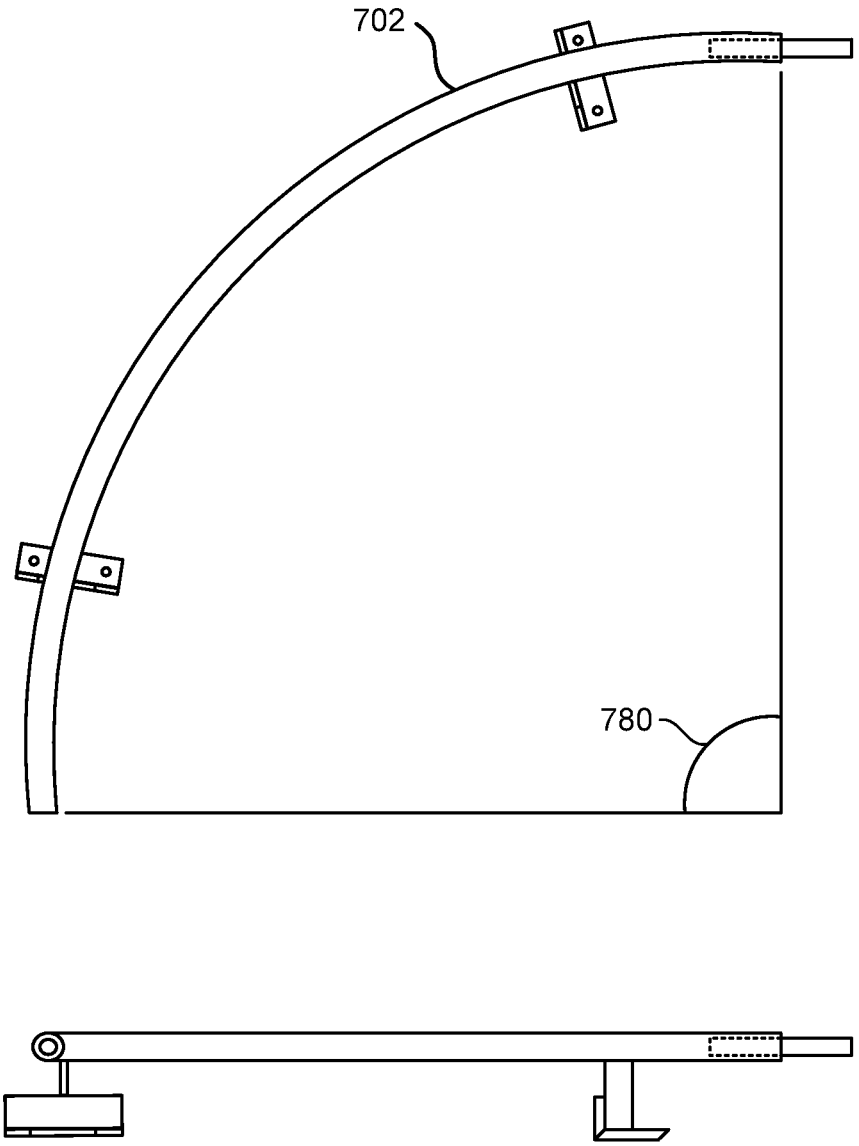
FIG. 7*b* is a schematic diagram illustrating another embodiment of a corner of the track in accordance with embodiments of the disclosure.

FIG. 7*b* is a schematic diagram illustrating another embodiment of a corner of the track 102 in accordance with embodiments of the disclosure. The corner 802 may have an arc length of about 8 feet. The corner 802, as opposed to the corner described above with reference to FIG. 7*a*, may be continuously curved as depicted. Each endless track 102 may be formed of a plurality of corners 750, with each corner defining a 90 degree turn (i.e., a central angle 780 of 90 degrees) and blending into the next corner. In another embodiment, a length of straight tubing may be disposed between the corners.

Figure 8:
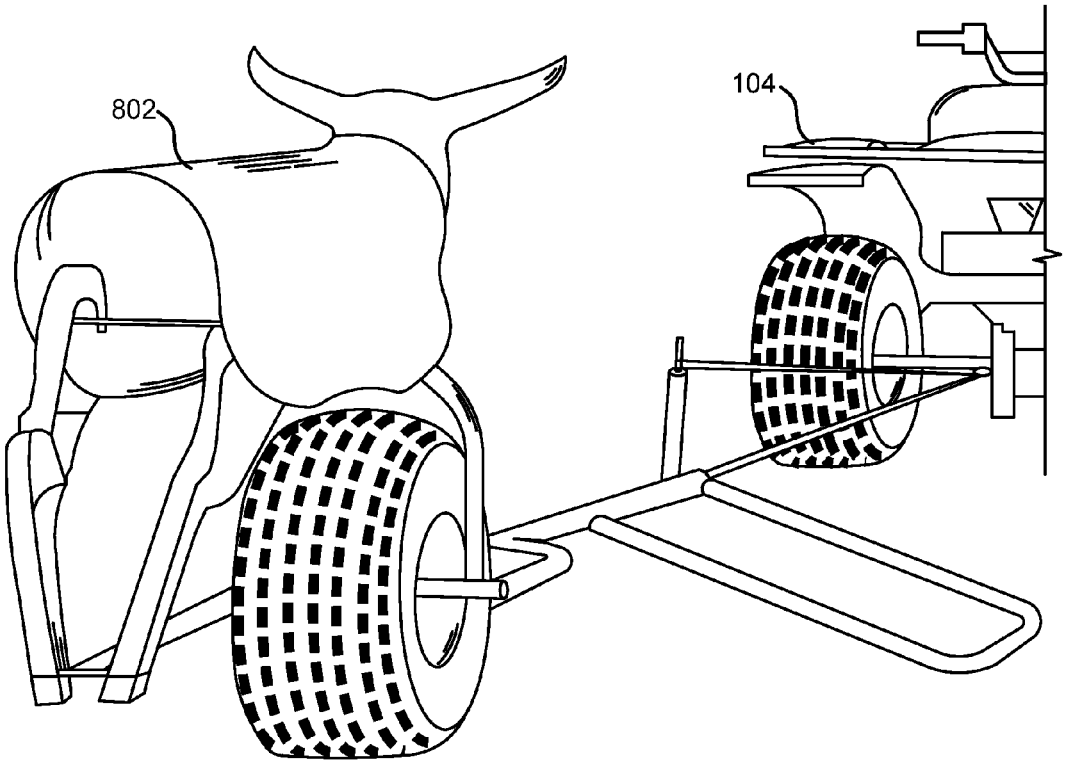
FIG. 8 is a perspective view illustration demonstrating a towable roping device in accordance with embodiments of the disclosure.

FIG. 8 is a perspective view illustration demonstrating a towable roping device (i.e., towable dummy) in accordance with embodiments of the disclosure. The embodiments of the disclosure are beneficially configured to, in an automated manner, tow a number of prior art roping devices 802 or dummies. The vehicle 104, as depicted, is an all-terrain vehicle capable of towing the roping device 802 at a speed selected to simulate the roping of a real steer. Additionally, as the vehicle 104 follows the path defined by the track 102, the roping device 802 "cuts" in a manner similar to a real steer as the vehicle 104 travels around the corners (see FIGS. 7*a* and 7*b*) and then straightens out.

In one embodiment, a roping device capable of use in accordance with embodiments of the disclosure is the Hot Heels roping steer manufactured by Hot Heels of Hinton Iowa. Alternatively, the roping device 802 may be integrally formed with the vehicle 104. In other words, a roping device may be attached, for example, to a cargo rack of the vehicle 104. Furthermore, the roping device 802 may comprise any towable roping dummy or roping practice device. Alternatively, a prior art roping device 802 may be mounted to the vehicle 104.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus for self-propelled roping training, the apparatus comprising:

an endless track comprising a plurality of corner sections, each of the plurality of corner sections comprising an arc length;

a carriage assembly comprising a front slider assembly coupled with the track and a rear slider assembly coupled with the track; and a self-propelled vehicle coupled with the carriage assembly configured to follow a path defined by the endless track.

2. The apparatus of claim 1, where the arc length of each of the plurality of corners is in the range of between about 6 and 9 feet.

3. The apparatus of claim 2, where each of the plurality of corners comprises a central angle of about 90 degrees.

4. The apparatus of claim 1, where the carriage assembly further comprises a distance between the first slider assembly and the rear slider assembly in the range of between about 69 and 72 inches.

5. The apparatus of claim 1, where the carriage assembly further comprises a distance between the first slider assembly and the rear slider assembly of about 70⅝ inches.

6. The apparatus of claim 5, where the arc length of each of the plurality of corners is about 8 feet.

7. The apparatus of claim 1, further comprising a steering arm disposed between the self-propelled vehicle and the carriage assembly.

8. The apparatus of claim 7, where the steering arm is pivotally coupled at a first end with the carriage assembly and is pivotally coupled at a second end with the self-propelled vehicle.

9. The apparatus of claim 1, further comprising a roping device coupled with the self-propelled vehicle.

10. The apparatus of claim 9, where the roping device is a towable roping dummy.

11. A device comprising:

a steering sleeve comprising an integrated handlebar, where the integrated handlebar is rigidly coupled with a self-propelled vehicle;

a steering arm pivotally coupled with the steering sleeve at a first end;

a carriage assembly pivotally coupled with a second end of the steering arm and comprising a front slider assembly coupled with an endless track and a second slider assembly coupled with the endless track; and where the endless track comprises a plurality of corner sections, each of the plurality of corner sections comprising an arc length.

12. The device of claim 11, where the arc length of each of the plurality of corners is in the range of between about 6 and 9 feet.

13. The device of claim 12, where each of the plurality of corners comprises a central angle of about 90 degrees.

14. The device of claim 11, where the carriage assembly further comprises a distance between the first slider assembly and the rear slider assembly in the range of between about 69 and 72 inches.

15. The device of claim 11, further comprising a roping device coupled with the self-propelled vehicle.

16. The device of claim 15, where the roping device is a towable roping dummy.

17. A system comprising:

a towable roping dummy coupled with a self-propelled vehicle, where the self-propelled vehicle is pivotally coupled with a first end of a steering arm;

a carriage assembly pivotally coupled with a second end of a steering arm, where the carriage assembly comprises a front slider assembly coupled with an endless track and a rear slider assembly coupled with the endless track; and where the endless track defines a path for the self-propelled vehicle to follow and comprises a plurality of corner sections, each of the plurality of corner sections comprising an arc length.

18. The system of claim 17, where the arc length of each of the plurality of corners is in the range of between about 6 and 9 feet.

19. The system of claim 18, where each of the plurality of corners comprises a central angle of about 90 degrees.

20. The apparatus of claim 17, where the carriage assembly further comprises a distance between the first slider assembly and the rear slider assembly in the range of between about 69 and 72 inches.

* * * * *